US006040018A

United States Patent [19]

Lamers

[11] Patent Number: 6,040,018

[45] Date of Patent: Mar. 21, 2000

[54] METHOD FOR REINFORCING A BOARD, SHEET OR FOIL

[75] Inventor: Jacobus Stephanus Lamers, Bemmel, Netherlands

[73] Assignee: Lamers Beheer B.V., Gendt, Netherlands

[21] Appl. No.: 08/984,867

[22] Filed: Dec. 4, 1997

[51] Int. Cl.[7] ..... B05D 3/06; B05D 3/12

[52] U.S. Cl. ..... 427/510; 427/512; 427/285; 427/289; 427/391; 427/392

[58] Field of Search ..... 427/510, 512, 427/285, 289, 391, 392, 290

[56] References Cited

U.S. PATENT DOCUMENTS

| | | | |
|---|---|---|---|
| 3,479,203 | 11/1969 | Broadhurst | 427/285 |
| 4,176,212 | 11/1979 | Brack | 427/510 |
| 4,234,635 | 11/1980 | Atkinson | 427/285 |
| 4,446,175 | 5/1984 | Brixius et al. | 427/512 |
| 4,767,643 | 8/1988 | Westervelt et al. | 427/512 |
| 4,910,066 | 3/1990 | Foisie | 427/285 |
| 5,204,142 | 4/1993 | Okumura | 427/285 |
| 5,817,377 | 10/1998 | Trokhan et al. | 427/510 |

*Primary Examiner*—Katherine A. Bareford
*Attorney, Agent, or Firm*—Webb Ziesenheim Logsdon Orkin & Hanson, P.C.

[57] ABSTRACT

The invention relates to a method for reinforcing a board, sheet or foil of fibrous material, which method comprises the following steps, to be performed in suitable sequence, of:

(a) providing the board, the sheet or the foil of fibrous material;

(b) providing a curable liquid;

(c) impregnating with said liquid at least a zone of the board, the sheet or the foil for reinforcing; and (d) casing this liquid to cure.

The invention also relates to a board, sheet or foil of fibrous material reinforced by use of the method.

18 Claims, 6 Drawing Sheets

METHOD FOR REINFORCING A BOARD, SHEET OR FOIL

BACKGROUND OF THE INVENTION

Packagings are known for instance for foil material. Such foil material can consist of plastic, aluminium, paper or the like. For domestic use rolls of such material are packed in elongate cardboard boxes from which the foil strip can be unrolled and torn off along a prearranged saw edge. A metal saw edge is usual, while the use of a saw edge of hard plastic is also known.

The drawback to such a structure is that the packaging remaining after the foil material has been used does not have the character of a single material, which makes the packaging difficult or even unsuitable for recycling.

It is an object of the invention to provide a method for reinforcing a board, sheet or foil of fibrous material which ensures that the quality of the single material remains practically unimpaired in that the or each reinforced zone makes only a negligible contribution to the material composition as a whole and the packaging for recycling can therefore be treated as a recyclable single material.

SUMMARY OF THE INVENTION

In respect of the above the invention provides a method for reinforcing a board, sheet or foil of fibrous material, which method comprises the following steps, to be performed in suitable sequence, of:

(a) providing the board, the sheet or the foil of fibrous material as a performed blank;

(b) providing a curable liquid;

(c) impregnating with the curable liquid a zone of the performed blank, with the zone extending between opposite edges of the performed blank;

(d) causing the curable liquid to cure such that a reinforced zone forms extending between the opposite edges of the preformed blank; and (e) separating by a separating operation the reinforced zone into two complementary edges such that the preformed blank is divided into two substantially identical parts, and wherein step (e) of the method occurs after step (c) of the method.

It will be apparent that the curable liquid must be of a type which lends itself to being an impregnating liquid for the chosen material. This particularly implies that the liquid and the material may not be mutually repellent. Impregnation in any case assumes the possibility of the liquid saturating the fibrous and therefore porous material.

The fibrous material may contain natural fibers such as paper and/or cardboard. The fibrous material may also contain plastic fibers such as polypropylene fibers. In addition, the fibrous material may be a non-woven fibrous material.

The curing step of the method may take place at least partially with a thermal treatment. Additionally, the curing step may take place with a chemical treatment, as for instance with the addition of a catalyst. The curing step may also take place by moisture action, particularly in the case wherein the step of providing a curable liquid is performed by providing liquid polyurethane as the curable liquid Furthermore, the curing step may take place by irradiation with ultraviolet radiation.

The curable liquid may be a liquid consisting of two pre-mixed components. The curable liquid may also be a lacquer or lacquer-like curable liquid that cures under the action of ultraviolet radiation. Furthermore, the curable liquid may be a cyano-acrylate.

The impregnating step of the method may take place under pressure.

The method may further include a pre-treatment or after-treatment modelling operation, such as perforation. In addition, the method may be performed such that the board, the sheet or the foil of fibrous material, at least in the reinforced zone, complies with at least one of the following predetermined mechanical requirements, as examples: hardness, toughness, wear-resistance, ability to bend and stretchability.

The separating operation of the method may be performed so that the complementary edge parts define a saw shape.

A possible application of the method according to the present invention is the reinforcing of for instance paper in the region of perforations. Such payer is very suitable for administrative purposes. It is known that during use perforations are mechanically relatively heavily loaded after being placed into a document file or the like and that there is therefore a danger of tearing. A local reinforcing round the relevant perforations can prelude this danger. The perforation can take place before or after performing of the method according to the invention. Execution after the method has the advantage that the amount of liquid to be used is limited and that perforating of non-reinforced paper of course takes place more easily and with less force than in the case of the reinforced paper.

One example of an application found in the prior art as discussed above, are metal or plastic saw edges. However, in the embodiment according to the invention the saw edges of the packagings in question consist of for instance cardboard which is reinforced locally as according to the invention. The saw edges are formed with a simple punching operation such that one blank which has been locally reinforced in the middle is divided by one punching operation into two identical parts, wherein the separation zone corresponds with the reinforced saw edge zones. It is noted that the described embodiment relates to local reinforcing of a blank, whereby the saw edge and the rest of the packaging are formed integrally or take a monolithic form. It will be apparent that a saw edge can also be manufactured separately by reinforcing a strip of cardboard or paper in accordance with the teaching of the invention which is then processed in order to obtain a saw edge. This saw edge can be adhered to the packaging with for instance a very thin glue layer. This glue layer can also be of a nature and quantity such that the total quality of the packaging as single material remains essentially unimpaired.

It will be apparent that the invention is not limited to local reinforcing of fibrous material but that a whole board, sheet or foil can be provided with a reinforcement. The invention may also be applied to adhere a reinforced board, sheet or foil to a nonreinforced board, sheet or foil, whereby a laminate-like structure results which has improved mechanical properties.

The invention also relates to a board, sheet or foil obtained with the method according to this invention.

BRIEF DESCRIPTION OF THE DRAWINGS

The invention will now be elucidated with reference to the annexed drawings. Herein.

DESCRIPTION OF THE PREFERRED EMBODIMENTS

Figure 1:
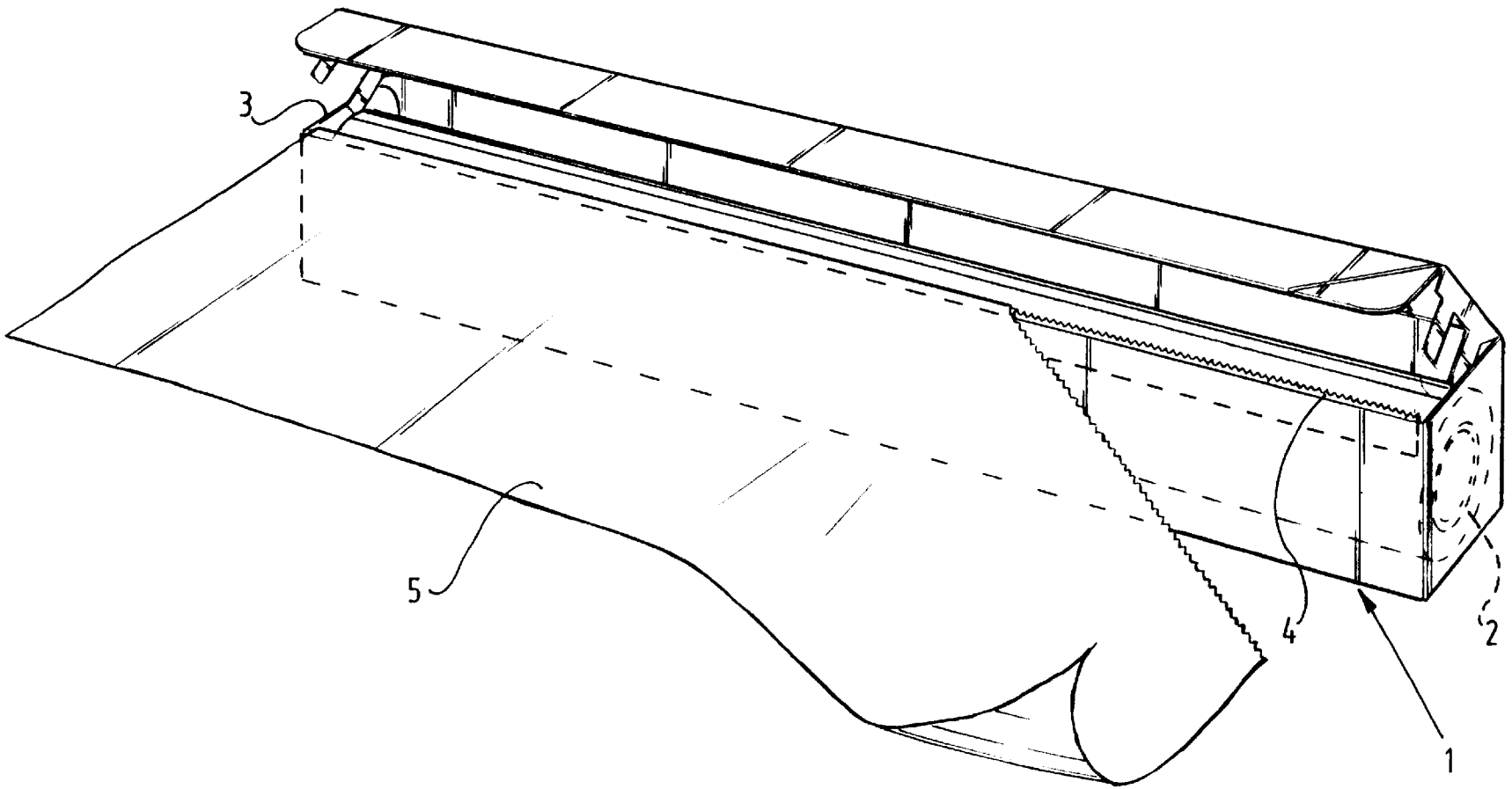
FIG. 1 shows a perspective view of an elongate box in which a roll of foil is accommodated, which box is provided with a saw edge formed in accordance with the teaching of the invention.

FIG. 1 shows an elongate box 1 in which is situated a roll 2 of foil material, for instance of plastic or aluminium. Box 1 comprises a mouth edge 3, the leading zone of which is provided with a saw edge 4. Box 1 is manufactured in known manner from cardboard. A usual saw edge consists of aluminum. According to the invention however, the saw edge is embodied in cardboard which is reinforced by a plastic impregnated and cured in the cardboard material. In this way a sheet 5 of foil material can be torn off easily in the shown manner along saw edge 4.

Figure 2:
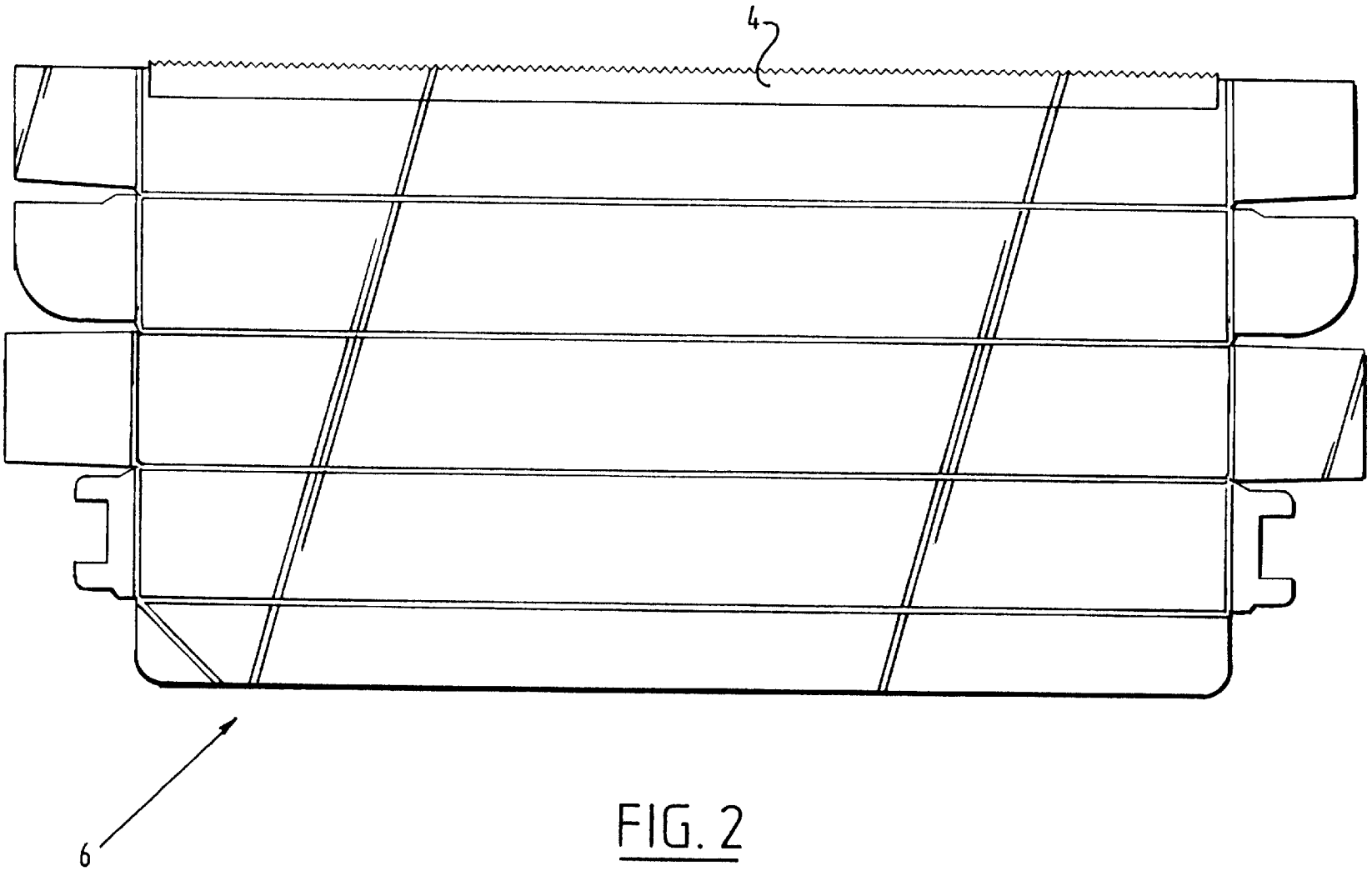
FIG. 2 shows a blank of the box according to FIG. 1.

FIG. 2 shows a blank 6 suitable for forming the box 1 by folding together and glueing.

Figure 3:
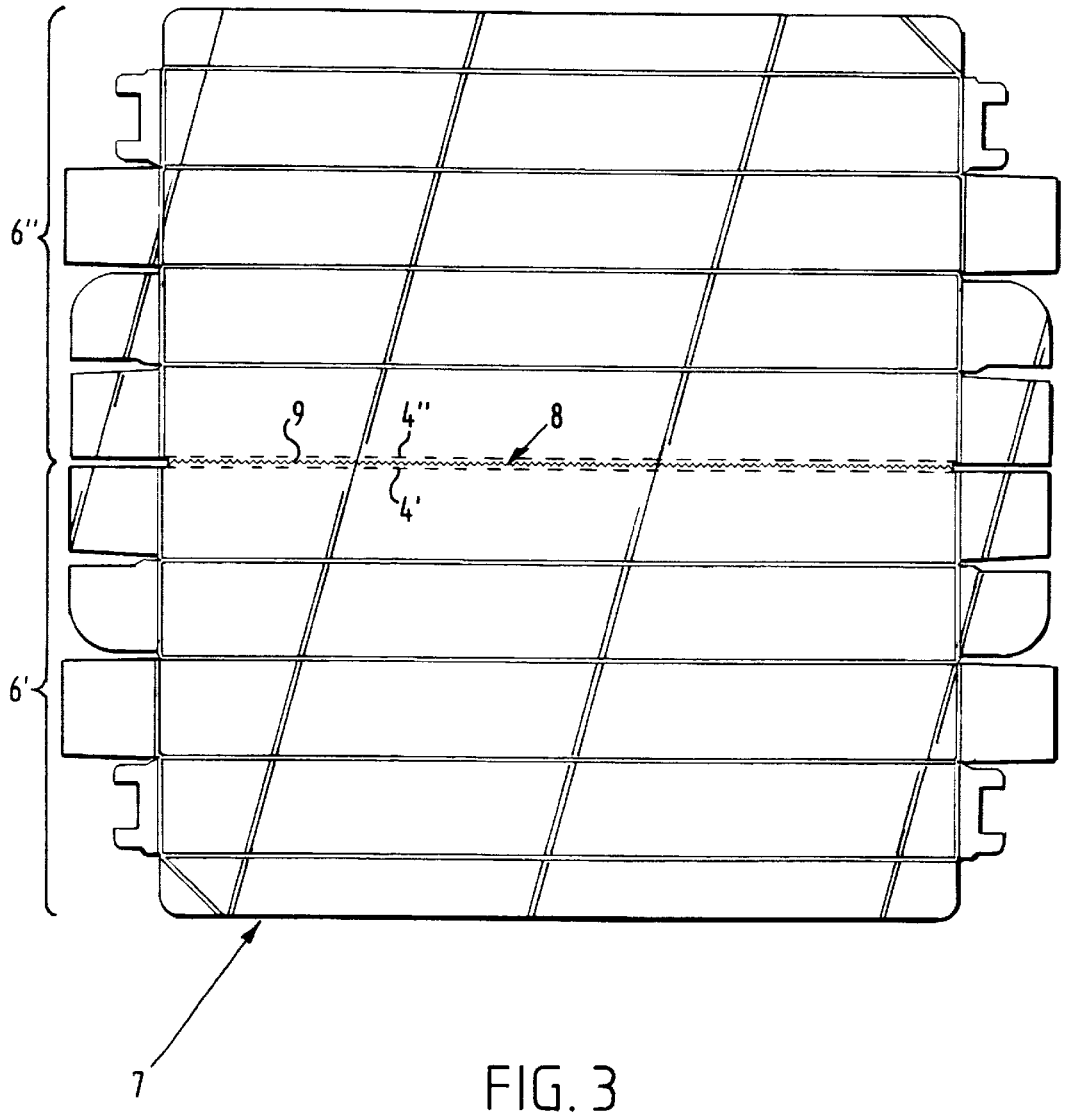
FIG. 3 shows a pre-blank consisting of two blanks as according to FIG. 2 which are mutually separated via complementary saw edges.

FIG. 3 shows a pre-blank 7 consisting of two blanks 6', 6" as according to FIG. 2. The middle zone 8 of the pre-blank is reinforced by an impregnated and cured plastic. The zone in question is separated into two parts by a punching operation, wherein the separation zone takes a zigzag firm and is designated with 9. The zones 4', 4" adjacent thereto form the respective saw cuts which correspond functionally with saw blade 4 of FIGS. 1 and 2. In this embodiment however, other than in FIGS. 1 and 2, the saw edge or saw blade 4 is not embodied separately but this edge forms part of the blanks 6', 6".

Figure 4:
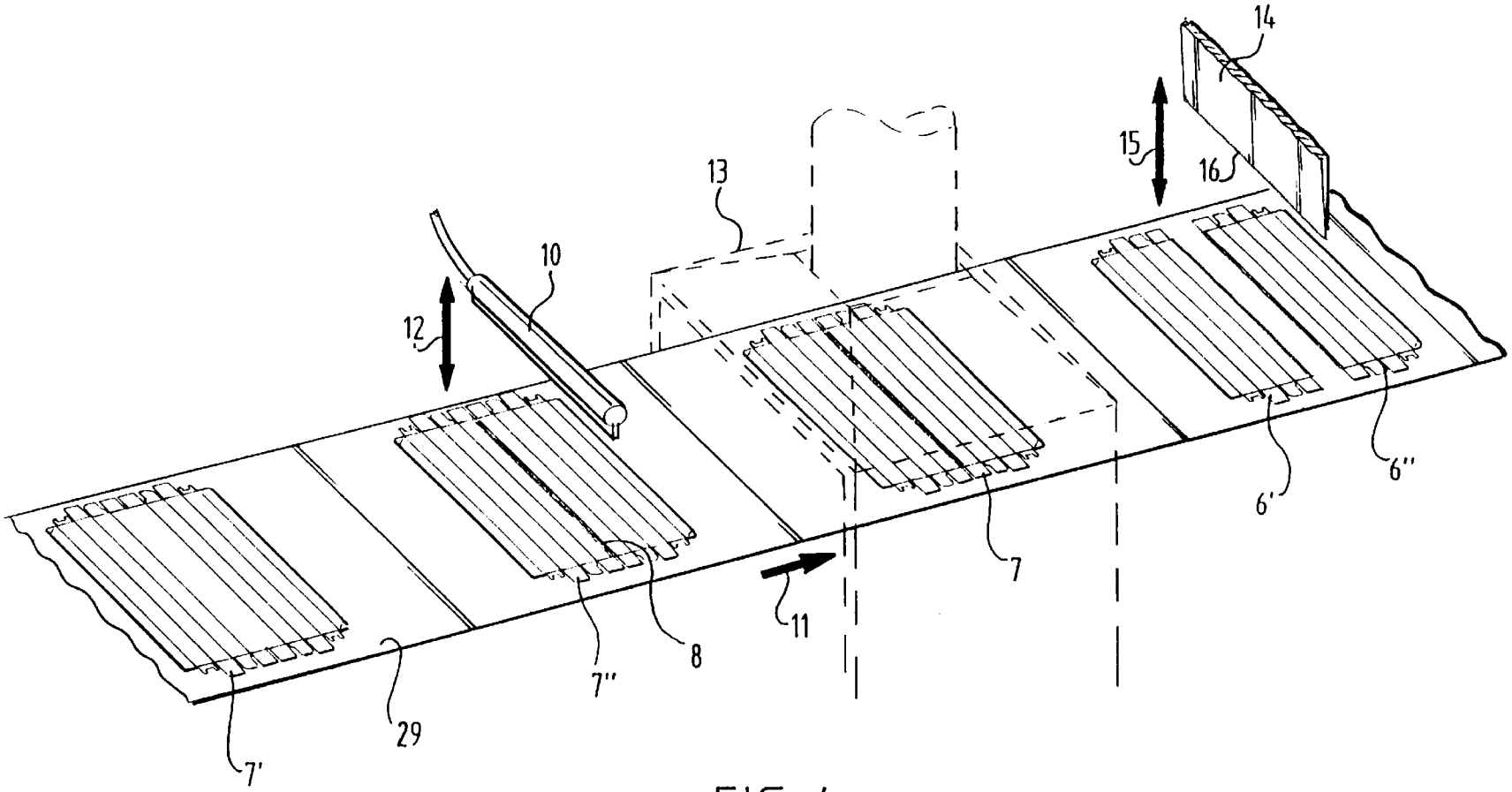
FIG. 4 is a schematic perspective view of a process for forming the reinforced middle zone of the pre-blank according to FIG. 3 and forming the saw edges while separating the flanks.

FIG. 4 shows the manner in which pre-blank 7 and blanks 6', 6" can be manufactured. The starting point is a basic blank 7'which is carried by transport via a conveyor belt 29 to an impregnating station 10. The transport direction of a conveyor belt 29 is designated with arrow 11. Impregnating station 10 is movable up and downward as according to arrow 12 and is adapted for impregnation under pressure of a thermally curable reinforcing plastic. The thus impregnated middle zone can be effectively reinforced by heating pre-blank 7" at the location of a downstream positioned heating station 13 in order to obtain pre-blank 7 (see FIG. 3) with a middle zone reinforced with cured plastic. Further transport of pre-blank 7 carries his blank with reinforced middle zone to a schematically designated separating device 14 shown as a knife movable up and downward as according to 15. The knife has a cutting edge 16 with a serrated form corresponding with separation zone 9 of FIG. 3. By moving knife 14 downward with force the pre-blank 7 can be divided into two blanks 6, 6' as in FIG. 3.

Figure 5:
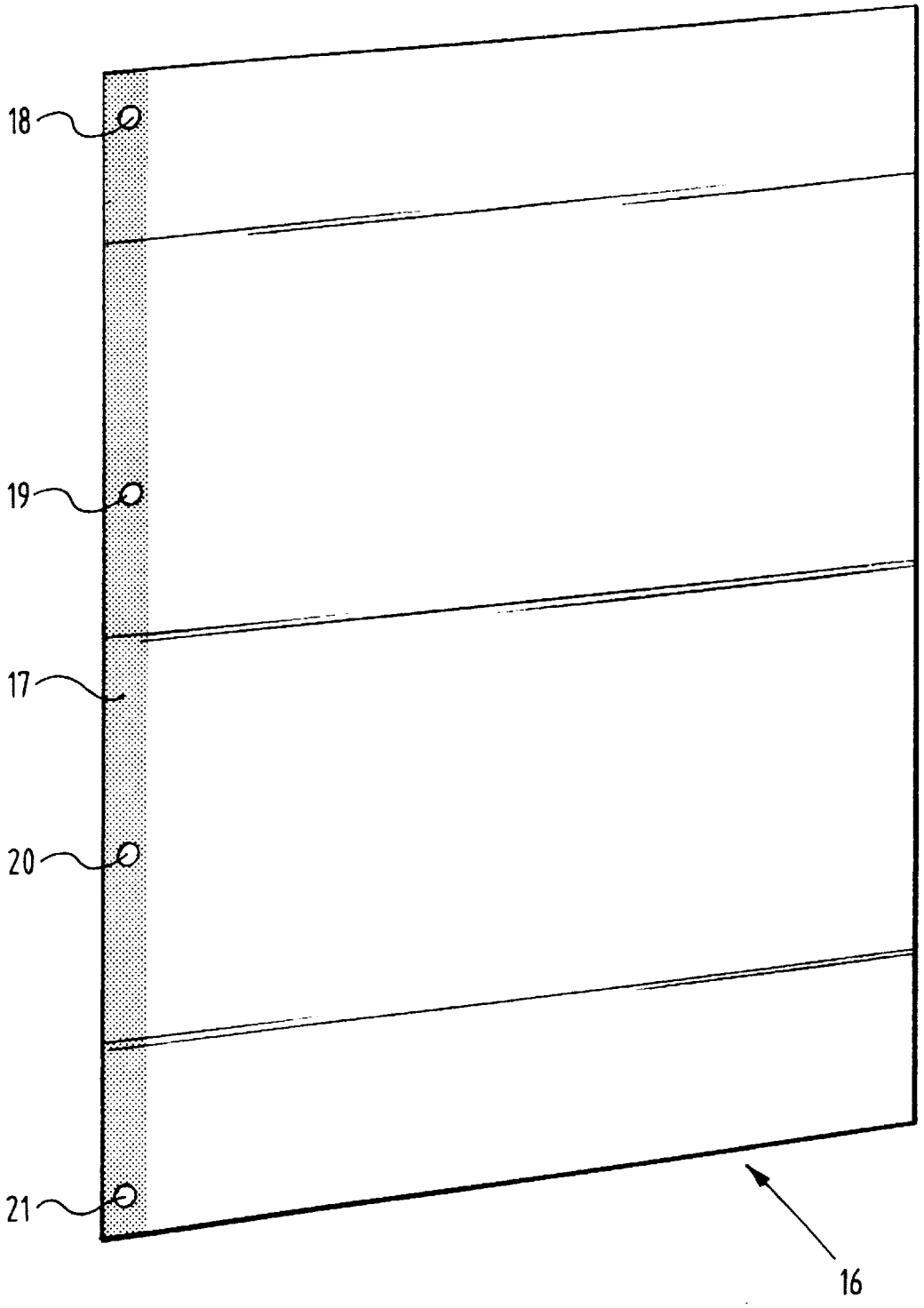
FIG. 5 shows a sheet of paper with an edge zone reinforced as according to the invention in which perforations are arranged.

FIG. 5 shows a sheet 17 of paper. The sheet is provided with an edge 17', as shown in FIG. 6 discussed below, which is reinforced by cured impregnated plastic and in which perforations 18, 19, 20, 21 are present.

Figure 6:
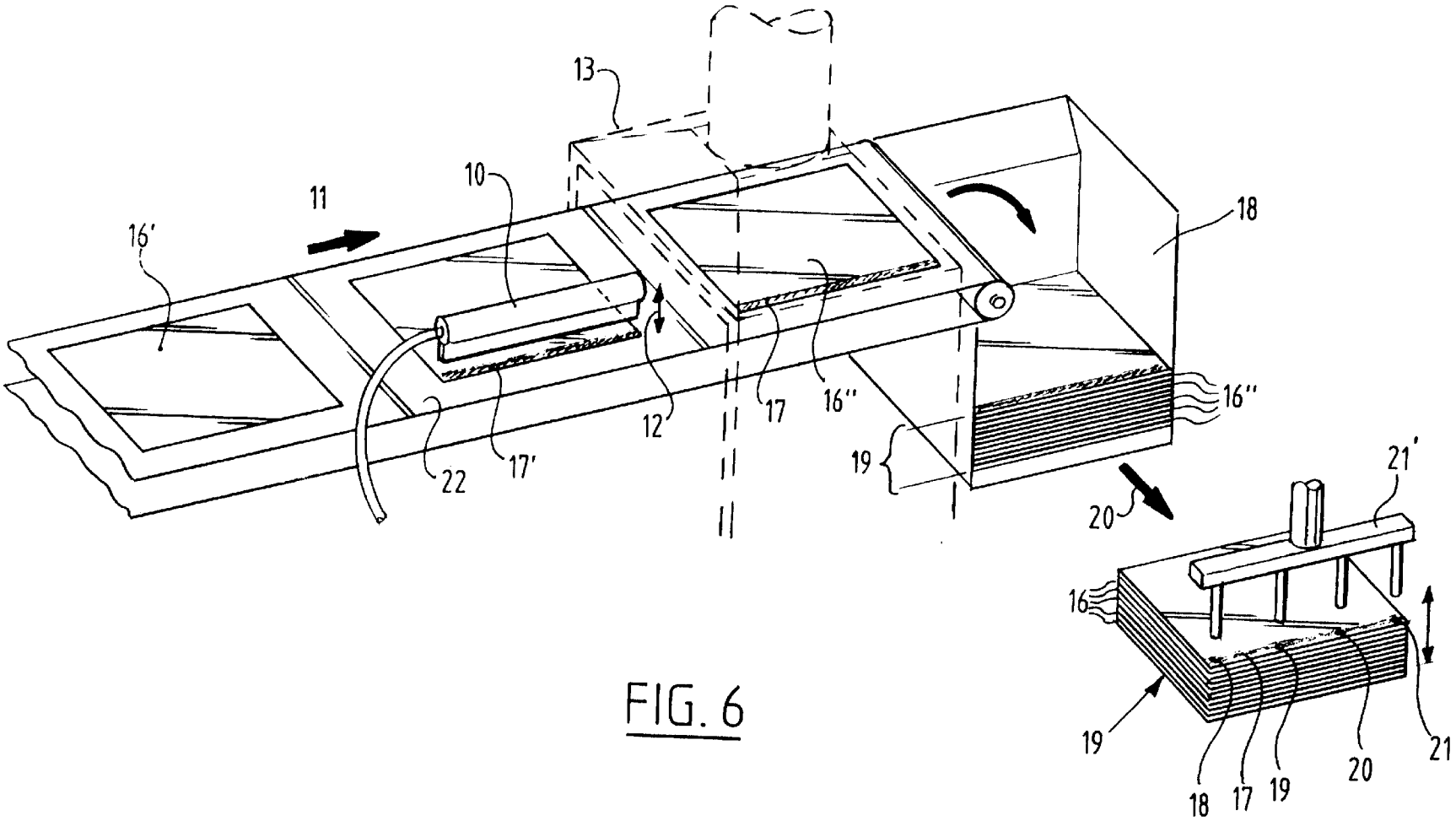
FIG. 6 is a schematic perspective view of a device for forming sheets of paper as according to FIG. 5.

FIG. 6 snows schematically a possible device which can manufacture the sheet 16 as according to FIG. 5. The starting point is a sheet of paper 16' which is carried by a conveyor belt 22 and which can be provided with an edge 17' impregnated with curable plastic by means of an impregnating device 10. The sheet of paper 16' is subsequently guided through heating device 13 to cause curing of the plastic in edge 17' in order to obtain a cured and reinforced edge 17. The thus obtained sheet 16" is then stacked in a stacker 18. After a certain stacking height has been reached a stack 19 is guided as according to arrow 20 to a perforating device where the holes 18, 19, 20, 21 are arranged in edge 17 by means of a schematically designated perforator 21'. It will be apparent that perforator 21' makes all said perforations through the entire stack 19 in one operation. A stack of sheets 16 as according to FIG. 5 is thereby completed. It is noted that, instead of the untreated sheet 16', sheets already perforated beforehand can also be supplied via conveyor belt 22. However, this has the drawback that at the position of impregnating station 10 plastic material reaches the conveyor belt 22 in the region of the arranged perforations and can cause fouling.

In respect of FIGS. 5 and 6, it is further noted that it is not required in all circumstances that the whole edge zone 17 be reinforced by cured plastic. If desired, a local reinforcement can suffice in the region of perforations 18, 19, 20 and 21. The embodiment of FIGS. 5 and 6 does however have the advantage not only that tearing of the perforations in question is effectively prevented in the case of rough handling, but also that the edge zone in question undergoes an effective stiffening, which in some circumstances may be a desirable side effect.

I claim:

1. A method for reinforcing a board, sheet or foil of fibrous material, the method comprising the steps of:

(a) providing the board, the sheet or the foil of fibrous material as a preformed blank;

(b) providing a curable liquid;

(c) impregnating with the curable liquid a zone of the preformed blank, with the zone extending between opposite edges of the preformed blank;

(d) causing the curable liquid to cure such that a reinforced zone forms extending between the opposite edges of the preformed blank; and (e) separating by a separating operation the reinforced zone into two complementary edges such that the preformed blank is divided into two substantially identical parts, and wherein step (e) of the method occurs after step (c) of the method.

2. The method as claimed in claim 1, wherein the fibrous material contains natural fibers.

3. The method as claimed in claim 2, wherein the fibrous material of natural fibers includes one of paper and cardboard.

4. The method as claimed in claim 1, wherein the fibrous material includes plastic fibers.

5. The method as claimed in claim 4, wherein the plastic fibers include polypropylene fibers.

6. The method as claimed in claim 1, wherein the fibrous material includes a non-woven fibrous material.

7. The method as claimed in claim 1, wherein step (d) of the method takes place at least partly with a thermal treatment.

8. The method as claimed in claim 1, wherein step (d) of the method takes place at least partly with a chemical treatment.

9. The method as claimed in claim 8, wherein the chemical treatment includes the addition of a catalyst.

10. The method as claimed in claim 1, wherein step (b) of the method takes place by providing the curable liquid in the form of two pre-mixed components.

11. The method as claimed in claim 1, wherein step (d) of the method takes place by moisture action.

12. The method as claimed in claim 1, wherein step (b) of the method takes place by providing a lacquer as the curable liquid that cures under the action of ultraviolet radiation, and wherein step (d) of the method takes place by irradiation with ultraviolet radiation.

13. The method as claimed in claim 1, wherein step (b) of the method takes place by providing a cyano-acrylate as the curable liquid.

14. The method as claimed in claim 1, wherein step (c) of the method takes place by impregnation under pressure.

15. The method as claimed in claim 1, further comprising a pre-treatment modelling operation.

16. The method as claimed in claim 1, further comprising an after-treatment modelling operation.

17. The method as claimed in claim 1, wherein the complementary edges define a saw shape.

18. The method as claimed in claim 1, wherein step (d) of the method takes place by moisture action and step (b) of the method is performed by providing liquid polyurethane as the curable liquid.

* * * * *

UNITED STATES PATENT AND TRADEMARK OFFICE

CERTIFICATE OF CORRECTION

PATENT NO. : 6,040,018
APPLICATION NO. : 08/984867
DATED : March 21, 2000
INVENTOR(S) : Jacobus Stephanus Lamers It is certified that error appears in the above-identified patent and that said Letters Patent is hereby corrected as shown below:

Title Page, insert:
Item -- [30] Foreign Application Priority Data
Dec. 7, 1996 [NL] Netherlands. . . . . .1004711--.

Title Page, Item [57] ABSTRACT Line 9 "(d) casing" should read -- (d) causing--.

Column 2 Line 18 "Such payer" should read --Such paper--.

Column 3 Line 8 "flanks;" should read --blanks;--.

Column 3 Line 11 "arranged," should read --arranged;--.

Column 3 Line 34 "zigzag firm" should read --zigzag form--.

Column 3 Line 54 "his blank" should read --this blank--.

Column 3 Line 65 "FIG. 6 snows" should read --FIG. 6 shows--

Signed and Sealed this

Seventeenth Day of July, 2007

JON W. DUDAS
*Director of the United States Patent and Trademark Office*